United States Patent [19]

Klusmier

[11] 4,308,958

[45] Jan. 5, 1982

[54] APPARATUS FOR SEPARATING UNACCEPTABLE ELONGATED ELEMENTS

[75] Inventor: Kenneth L. Klusmier, Worcester, Mass.

[73] Assignee: Morgan Construction Company, Worcester, Mass.

[21] Appl. No.: 131,143

[22] Filed: Mar. 17, 1980

[51] Int. Cl.[3] ..... B07C 5/14

[52] U.S. Cl. ..... 209/518; 209/942; 209/638; 209/657; 198/369

[58] Field of Search ..... 209/638, 639, 657, 517, 209/518, 519, 520, 521, 942; 198/360, 369

[56] References Cited

U.S. PATENT DOCUMENTS

| | | | |
|---|---|---|---|
| 2,976,993 | 3/1961 | Wheeler | 209/519 |
| 3,581,892 | 6/1971 | Aro | 198/360 |

*Primary Examiner*—Allen N. Knowles

*Attorney, Agent, or Firm*—Thompson, Birch, Gauthier & Samuels

[57] ABSTRACT

A apparatus for separating unacceptable elongated elements from a batch of such elements being dropped laterally and singly from a delivery mechanism into a receiver. The unacceptable elements are deflected away from their path of descent from the delivery mechanism to a laterally located discharge zone, from which the unacceptable elements are then removed longitudinally to a location remote from the receiver.

3 Claims, 8 Drawing Figures

APPARATUS FOR SEPARATING UNACCEPTABLE ELONGATED ELEMENTS

BACKGROUND OF THE INVENTION

This invention relates generally to the art of material handling and more particularly to an apparatus for separating unacceptable elongated elements from a batch of such elements being dropped laterally and singly from a delivery mechanism into a receiver.

Conventional reject systems are often unduly complex and expensive, and in many cases they are not adaptable to the handling of different product types such as both large and small diameter rounds, flats, angles, etc. There has been a long standing need for a solution to these problems, particularly in heavy industrial applications such as rolling mills.

SUMMARY OF THE INVENTION

An object of the present invention is the provision of a relatively simple and low cost apparatus for separating unacceptable elongated elements from a batch of such elements being fed to a receiver.

Another object of the present invention is the provision of an element separating apparatus which has the capability of handling a wide range of product types, including large and small diameter rounds, flats, angles, etc.

In a preferred embodiment of the invention to be hereinafter described in greater detail, bar products in a rolling mill are fed laterally by means of a chain conveyor onto stationary counting skids. The bars drop laterally and singly from the ends of the counting skids into the accumulating zone or receiver of a bundling bed where they are gathered and tied into bundles. A series of arms are located at the throat section of the accumulating zone. The arms are pivotally movable between inoperative positions on one side of the path of descent of bars through the throat section, and operative positions extending across the throat section and the path of bar descent therethrough. When in their inoperative positions, the arms preferably define one side of the throat section, and when in their operative positions, the arms are inclined downwardly towards a discharge zone. A roller conveyor is located at the discharge zone and serves as a means of longitudinally removing bars received thereon to locations remote from the accumulating zone. Preferably, the roller conveyor is designed to run in a forward or reverse direction, so that the unacceptable bars can be further segregated into those which can be salvaged by further processing, and those which cannot and thus must be scrapped.

Preferably, the discharge zone is located beneath the counting skids, thereby providing a compact arrangement which conserves mill space.

DESCRIPTION OF PRERERRED EMBODIMENT

Figure 1:
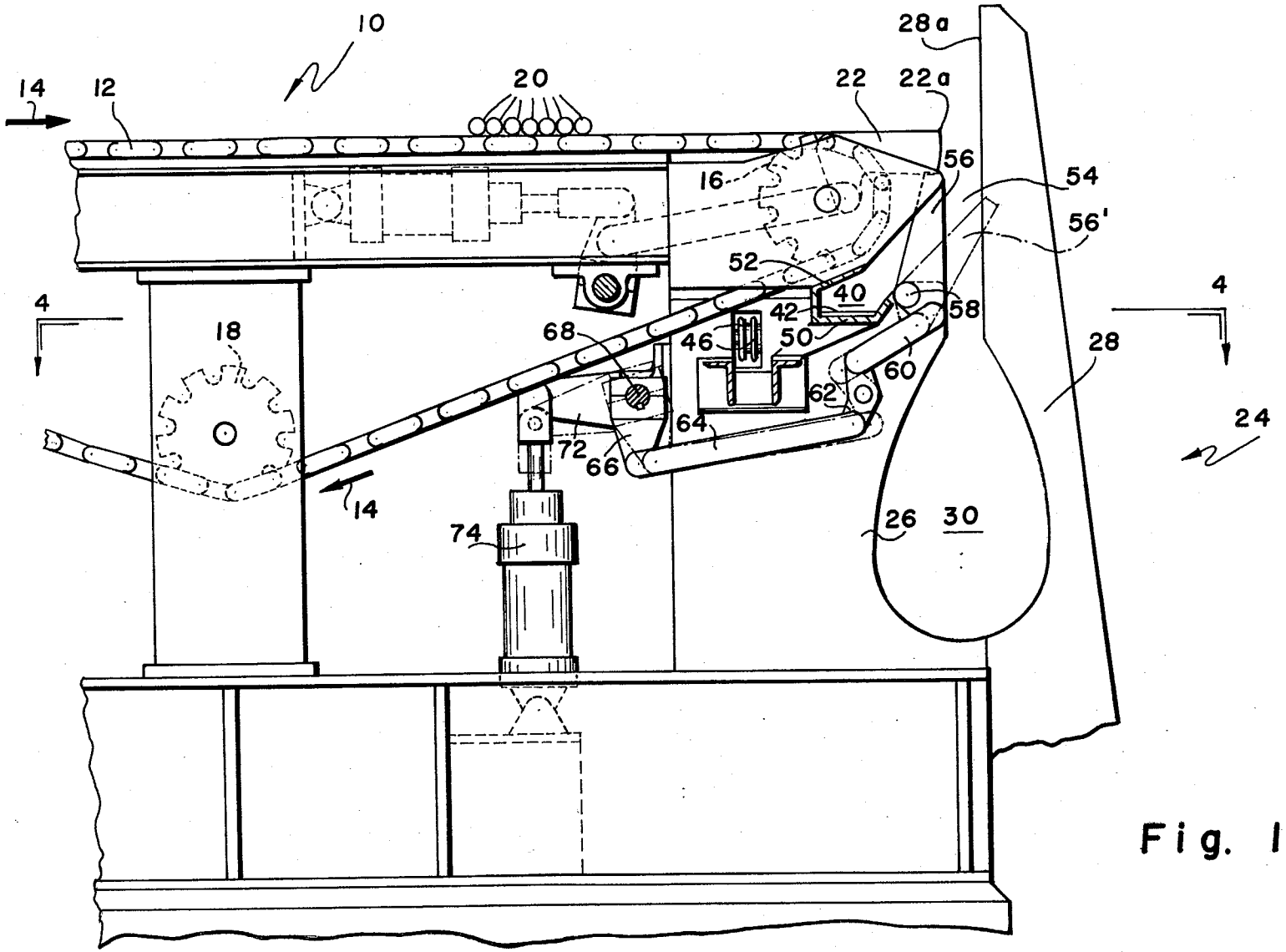
FIG. 1 is a vertical sectional view taken through an apparatus embodying the concepts of the present invention.
Figure 3:
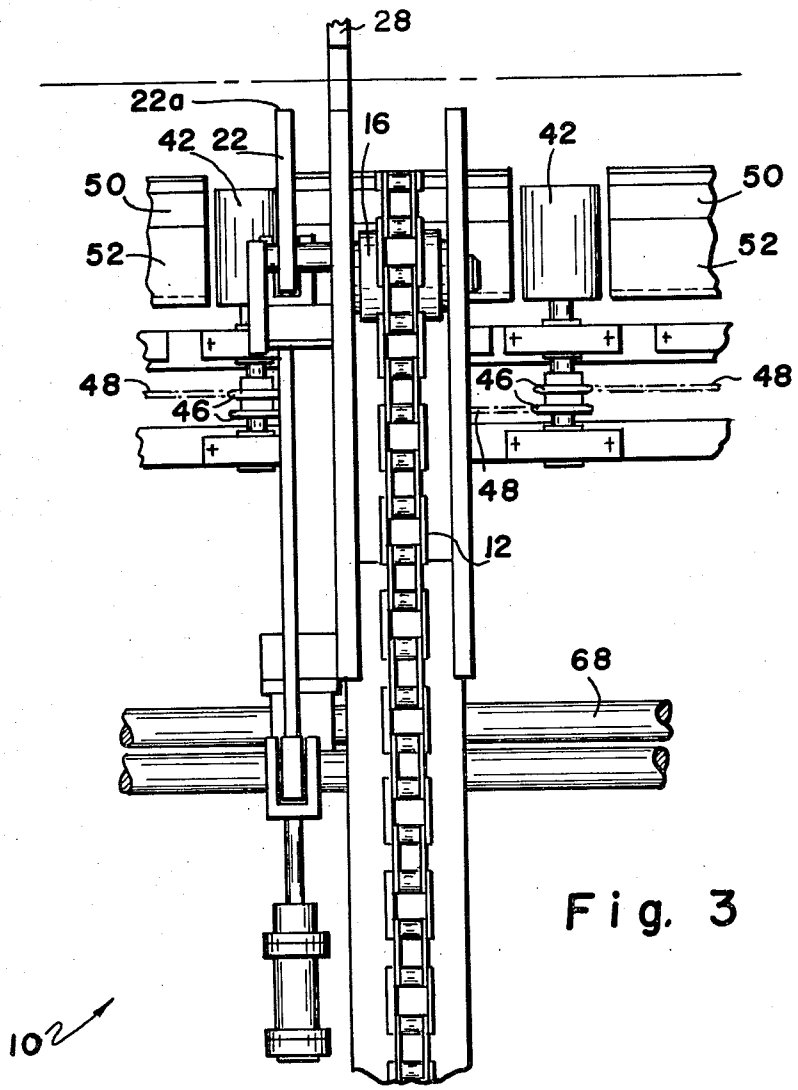
FIG. 3 is a partial top plan view of the apparatus.
Figure 2:
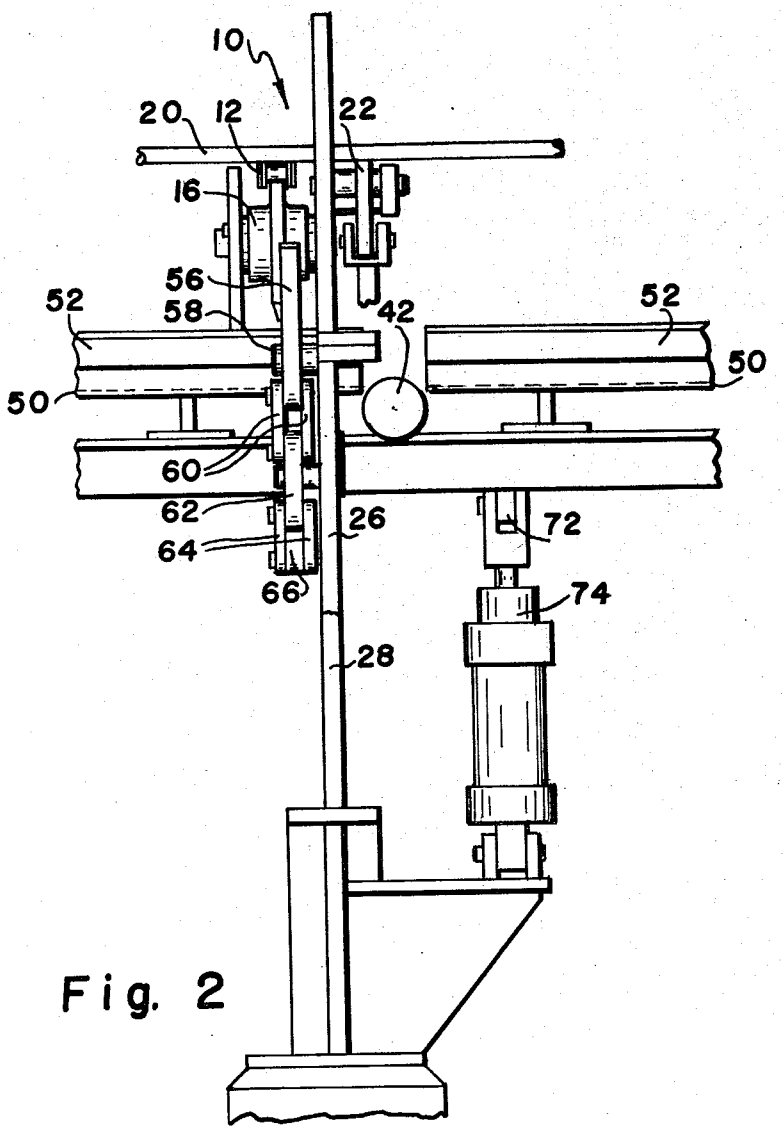
FIG. 2 is an end view of the apparatus looking from right to left in FIG. 1.

While the present invention has general utility in the handling of elongated elements in a wide range of industrial applications, it is of particular utility in the handling of bar products in a rolling mill, and thus it is in this environment that the following detailed description will be presented.

Referring now to the drawings, a delivery mechanism is generally indicated at 10. The delivery mechanism, which is the subject of a separate patent application U.S. Ser. No. 103,099 filed Dec. 13, 1979, includes a chain conveyor having multiple chains 12 driven in the direction indicated by arrows 14 around appropriately supported sprockets, several of which are shown at 16 and 18. Elongated elements, herein illustrated as round bars 20, are carried laterally on the chains 12 towards stationary counting skids 22. The counting skids 22 extend beyond the chains 12, and the forward edges 22*a* of the counting skids define a delivery point from which the bars are laterally and singly dropped into a receiver generally indicated at 24.

The receiver includes inner sides 26 comprising part of the support structure for the apparatus, and outer sides 28 which cooperate with the sides 26 to define a notch-like accumulating zone 30.

Figure 4:
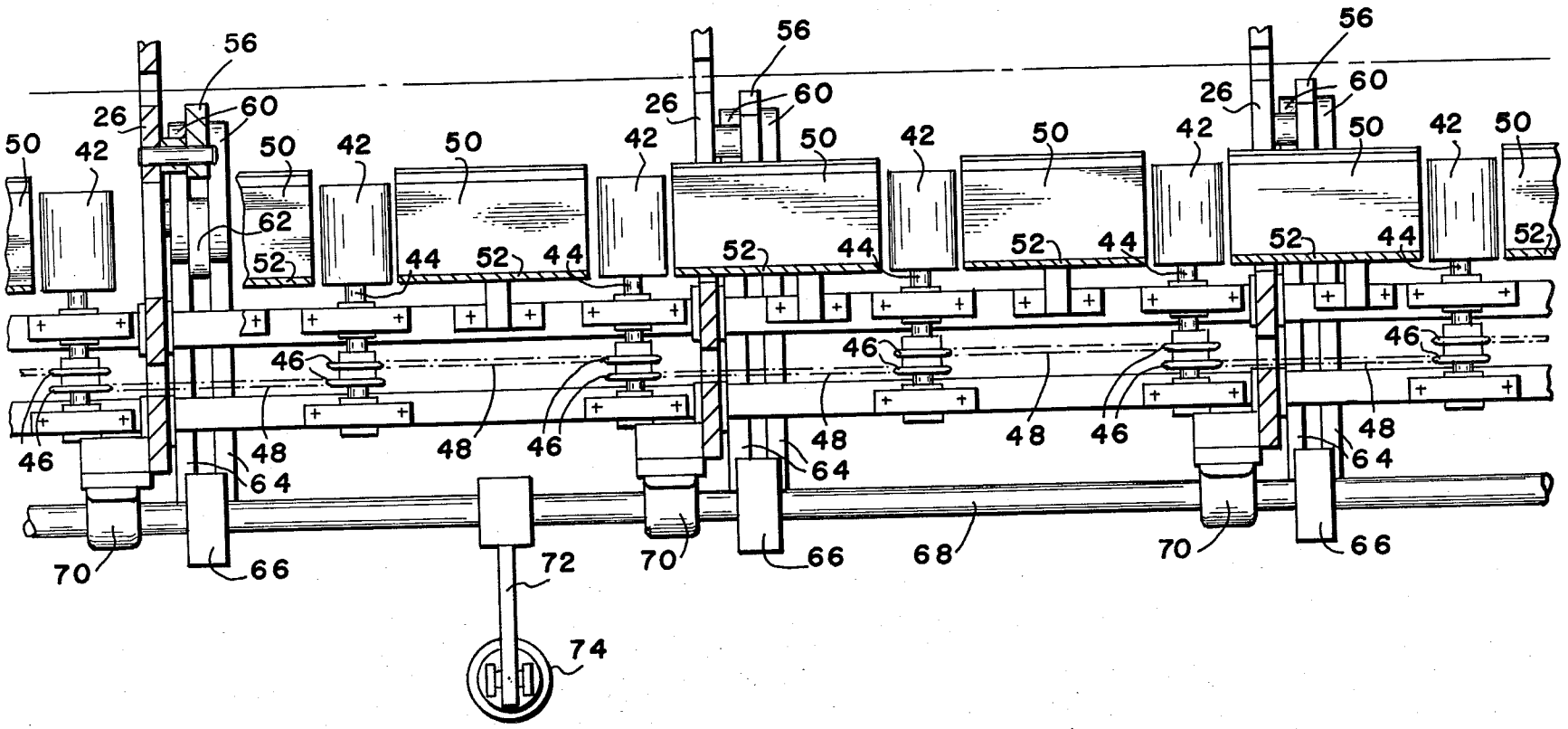
FIG. 4 is a horizontal sectional view taken on line 4—4 of FIG. 1; and, FIGS. 5A–5D are schematic illustrations showing a typical operational sequence of the invention.

A discharge zone generally indicated at 40 is located on one side of the accumulating zone 30. Preferably, in order to conserve space and provide a compact arrangement, the delivery zone 40 is arranged beneath the end of the delivery mechanism 10. The discharge zone is defined by a plurality of table rollers 42. As is best shown in FIG. 4, the table rollers 42 are supported in cantilever fashion on the ends of short shafts 44 which also carry chain sprockets 46. Groups of the table rollers 42 are mechanically interconnected by short chain sections 48 running between the sprockets 46. The table rollers can be driven in either direction by conventional gear motors (not shown).

The gaps between the table rollers 42 are occupied by apron plates 50 having angled back plates 52 associated therewith.

Bars leaving the forward edges 22*a* of the counting skids normally follow a path of descent through a throat section 54 leading downwardly to the accumulating zone 30. One side of the throat section is defined by the generally straight inside edges 28*a* of sides 28, and the opposite side of the throat section is defined by a plurality of reject arms 56. While it may be possible to adjustably support the reject arms in any one of a number of ways, preferably they are pivotally mounted as at 58 to the upper ends of the sides 26. When the reject arms 56 are thus inoperatively positioned on one side of the path of descent of bars through the throat zone 54, they effectively separate the throat zone from the discharge zone 40.

The reject arms 56 are each connected by intermediate links 60 to bell cranks 62 which are in turn connected by links 64 to crank arms 66 keyed to a common shaft 68 rotatably supported between pillow blocks 70 (see FIG. 4). Shaft 68 is parallel to the axis of the accumulating zone 30. Shaft 68 is rotatably adjustable by means of a crank arm 72 connected to a piston-cylinder unit 74. By operating piston-cylinder unit 74, the reject arms 56 are pivotally adjusted between their previously described upstanding inoperative positions, and operative positions extending across the throat section 54 and the path of bar descent therethrough, as shown by the dot-dash lines 56' in FIG. 1. When thus operatively positioned, the reject arms provide ramps inclined downwardly towards the discharge zone 40. These ramps serve to deflect selected bars onto the table rollers 42. The table rollers can then be activated to longitudinally remove the bars to locations remote from the accumulating zone 30.

Figure 5B:
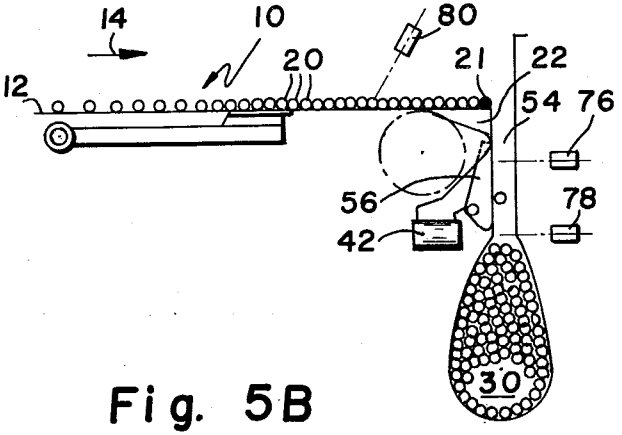
Figure 5A:
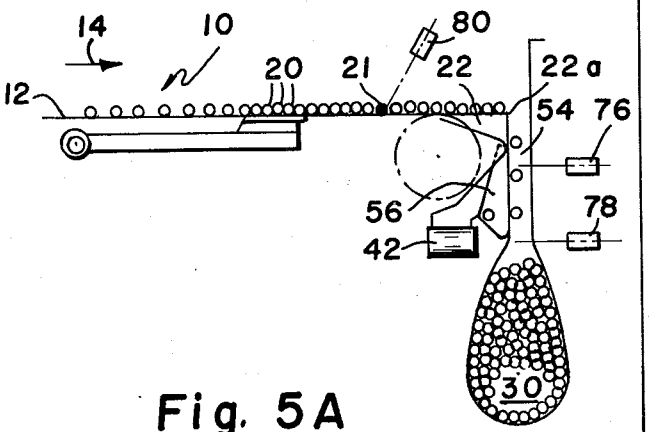

A typical operational sequence of the apparatus will now be described with reference to FIGS. 5A–5D. As shown in FIG. 5A, chain conveyor 12 is in operation at a normal delivery speed, laterally carrying bars 20 in the direction of arrow 14. As the bars are pushed across the counting skids 22, they are packed side-by-side. The bars eventually drop laterally and singly from the forward edges **22*a* of the counting skids. The bars descend through the throat section 54 past a counting sensor 76 and eventually arrive at the accumulating zone 30 where they are collected in zone 30. A second sensor 78 monitors the height of the bars accumulating in zone 30** and emits a signal when the zone is filled.

Periodically, it can be expected that unacceptable bars will be produced. The bars can be considered unacceptable for various reasons, perhaps the most common being shortness. In FIG. 5A, a "short" bar 21 is shown approaching the delivery end of the conveyor. Such shorts can be visually observed by operating personnel, or they can be automatically detected by sensors such as that shown at 80. However, regardless of the method or means of detection, as the short bar 21 approaches the forward edges **22*a* of the counting skids, the delivery speed of conveyor 12 is slowed (see FIG. 5B) so as to increase the time interval between successive bars being dropped into the throat section 54**.

Figure 5D:
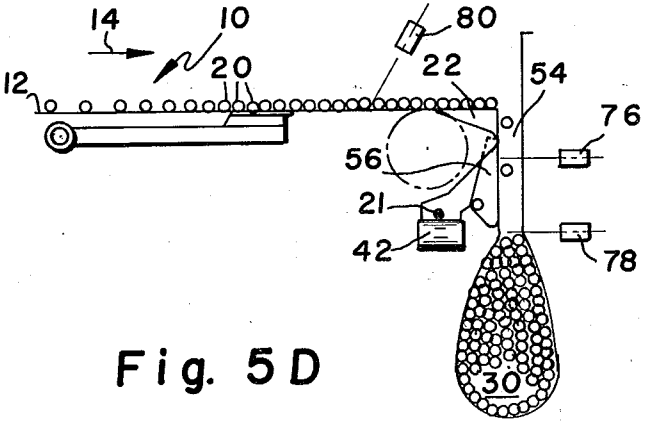
Figure 5C:
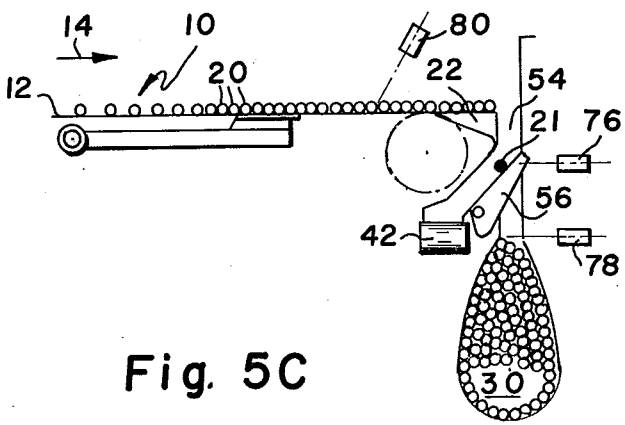

Then, as shown in FIG. 5C, before the short bar 21 can drop through the throat section, the reject arms 56 are pivoted to their operative position. The arms 56 thus define inclined ramps which serve to deflect the short bar 21 laterally and downwardly to the discharge zone 40. As soon as this deflection is complete, the reject arms 56 are returned to their inoperative positions as shown in FIG. 5D, and the normal delivery speed of the conveyor 12 is resumed. The short bar 21 is now on table rollers 42. Depending on whether or not the bar 21 can be salvaged, the rollers 42 can be operated in one direction to carry the bar to a salvage bin (not shown), or in the opposite direction to a scrap bin (also not shown).

It will thus be seen that the present invention provides a simple, efficient and low cost means for removing unacceptable elements from those being accumulated in a receiver. While the description has centered on the handling of rounds, those skilled in the art will understand that the invention is also applicable to other sections, including flats, angles, etc. In addition to providing a means of initially removing unacceptable elements from a continuous supply being fed to a receiver, the present invention also makes it possible to further segregate rejected elements into those which can be salvaged and those which must be scrapped.

I claim:

1. Apparatus for separating elongated unacceptable elements from a batch of elongated elements being dropped laterally and singly from the delivery end of a conveyor into an accumulating zone, said apparatus comprising:

(a) means underlying said conveyor for providing a discharge zone for unacceptable elements;

(b) first guide means spaced forwardly of said delivery end;

(c) second guide means arranged between said discharge zone and said first guide means; and (d) means for movably adjusting said second guide means between (i) a guide position underlying said delivery end and cooperating in spaced relationship with said first guide means to direct elongated elements along a downward path from said delivery end to said accumulating zone, and (ii) a deflecting position extending outwardly from beneath said delivery end and across said path to direct elongated elements to said discharge zone.

2. The apparatus of claim 1 wherein said first guide means extends vertically above the level of said delivery end.

3. The apparatus of claims 1 or 2 wherein said second guide means is pivotally adjustable between said guide and deflecting positions.

* * * * *